US008297444B2

(12) United States Patent
Miller

(10) Patent No.: US 8,297,444 B2
(45) Date of Patent: Oct. 30, 2012

(54) SEPARATION OF CARBON NANOTUBES USING MAGNETIC PARTICLES

(75) Inventor: Seth Adrian Miller, Englewood, CO (US)

(73) Assignee: Empire Technology Development LLC, Wilmington, DE (US)

( * ) Notice: Subject to any disclaimer, the term of this patent is extended or adjusted under 35 U.S.C. 154(b) by 309 days.

(21) Appl. No.: 12/546,516

(22) Filed: Aug. 24, 2009

(65) Prior Publication Data

US 2011/0042276 A1 Feb. 24, 2011

(51) Int. Cl.
*B07B 4/00* (2006.01)

(52) U.S. Cl. ..... 209/133; 209/214; 209/215; 209/232; 423/447.1; 252/502; 210/634

(58) Field of Classification Search ..... 209/133, 209/214, 215, 232; 210/634; 252/502; 423/447.1
See application file for complete search history.

(56) References Cited

U.S. PATENT DOCUMENTS

| | | | | |
|---|---|---|---|---|
| 6,987,302 | B1 * | 1/2006 | Chen et al. | 257/368 |
| 7,785,472 | B2 * | 8/2010 | Murakoshi | 210/656 |
| 2004/0232073 | A1 | 11/2004 | Papadimitrakopoulos | 210/634 |
| 2007/0258880 | A1 | 11/2007 | Murakoshi | 423/447.1 |
| 2008/0213159 | A1 * | 9/2008 | Sandhu | 423/447.1 |
| 2008/0308772 | A1 * | 12/2008 | Akasaka et al. | 252/502 |
| 2010/0012880 | A1 * | 1/2010 | Rampersaud et al. | 252/62.51 R |
| 2011/0132810 | A1 * | 6/2011 | Wainerdi et al. | 209/8 |

FOREIGN PATENT DOCUMENTS

JP 2007261839 A * 10/2007

OTHER PUBLICATIONS

International Search Report and Written Opinion dated Nov. 3, 2010, International Application No. PCT/US2010/046349, filed Aug. 23, 2010, 7 pages.

Chattopadhyay, D. et al., "A Route for Bulk Separation of Semiconducting from Metallic Single-Wall Carbon Nanotubes", J. Am. Chem. Soc. 125(11): 3370-3375, American Chemical Society, Washington DC, 2003,.

Grass, R. N. et al., "Covalently functionalized cobalt nanoparticles as a platform for magnetic separations in organic synthesis", Angewandte Chemie International Edition, vol. 46, Issue 26, pp. 4909-4912, (2007).

Lemieux, M. C. et al., "Self-Sorted, Aligned Nanotube Networks for Thin-Film Transistors", Science 321(5885) 101-104, Highwire Press, American Association for the Advancement of Science, Jul. 4, 2008.

* cited by examiner

*Primary Examiner* — Terrell Matthews
(74) *Attorney, Agent, or Firm* — Dorsey & Whitney LLP

(57) ABSTRACT

The present disclosure generally describes techniques for separating semiconducting carbon nanotubes from metallic carbon nanotubes in a carbon nanotube dispersion. The semiconducting carbon nanotubes and metallic carbon nanotubes may be provided and dispersed in a fluid. Once the semiconducting carbon nanotubes attach to the amine-coated magnetic particles, a magnetic field may be applied to the amine coated magnetic particles and attached semiconducting carbon nanotubes to attract and hold at least a portion of the semiconducting carbon nanotubes, so that the semiconducting carbon nanotubes may be separated from the fluid and/or metallic carbon nanotubes.

15 Claims, 5 Drawing Sheets

SEPARATION OF CARBON NANOTUBES USING MAGNETIC PARTICLES

BACKGROUND

Carbon nanotubes (CNTS) are allotropes of carbon with a nanostructure that may have a length-to-diameter ratio of up to approximately 28,000,000:1. They are cylindrical carbon molecules and have properties that make them potentially useful in many applications in nanotechnology, electronics, optics and other fields of materials science, as well as potential uses in architectural fields. Among their useful properties are high strength, the ability to carry electrical properties, and that they are efficient conductors of heat. Because carbon nanotubes are highly conductive, they may be able to transport electrons ballistically.

Crystallographic defects may occur in CNTs in the form of atomic vacancies. Such crystallographic defects may affect the properties of the CNTs. Specifically, such crystallographic defects may affect the electrical properties of the CNTs. Carbon nanotubes with specific types of defects act as excellent semiconductors, and are of interest as materials for future generations of transistors.

BRIEF DESCRIPTION OF THE FIGURES

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings.

In the drawings.

DETAILED DESCRIPTION

Figure 1:
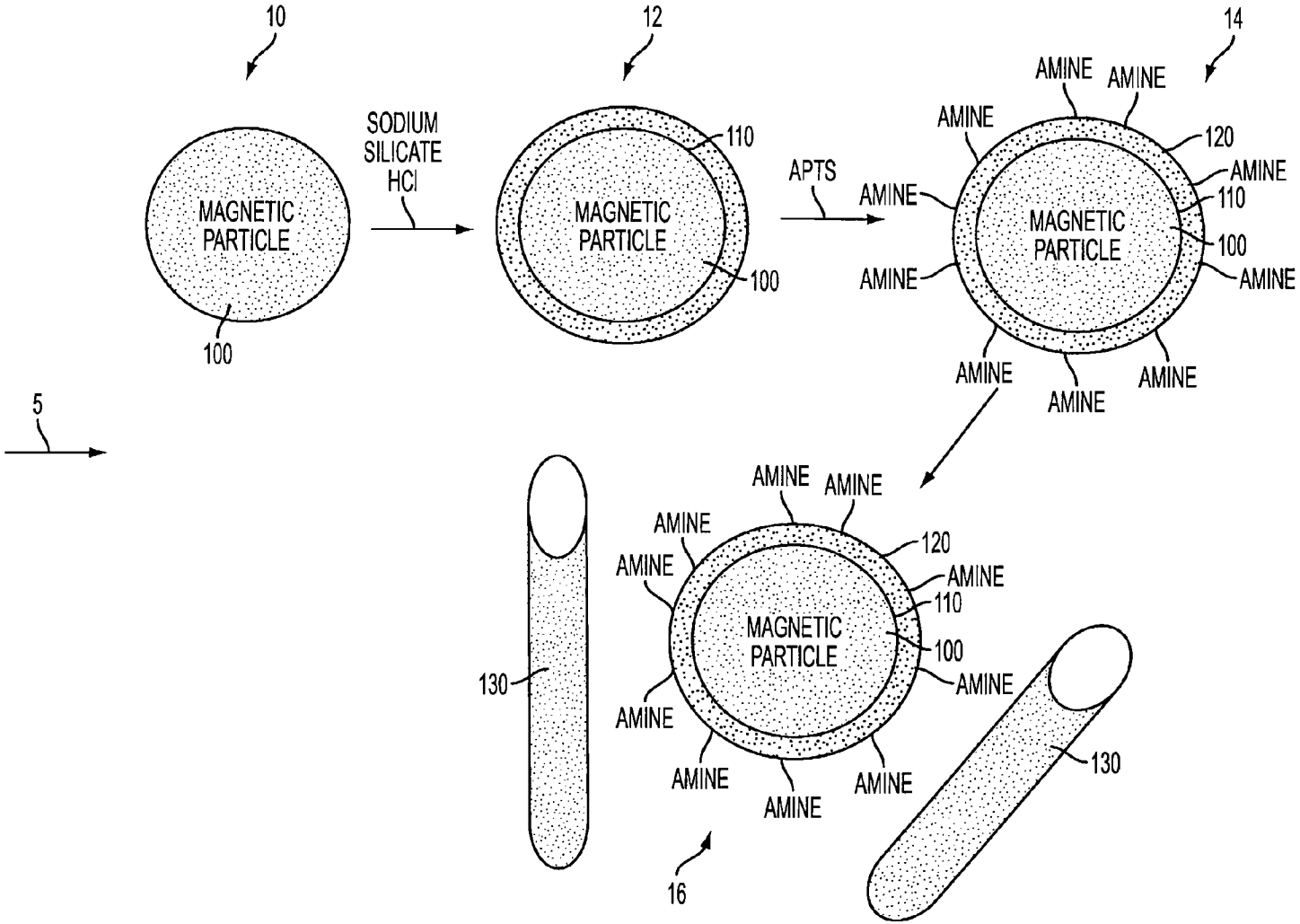
FIG. 1 depicts a process flow of modifying a magnetic particle with organic amines.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are implicitly contemplated herein.

Illustrative examples herein describe methods of separating semiconducting carbon nanotubes and metallic carbon nanotubes by preferential modification of semiconducting carbon nanotubes with magnetic particles, followed by magnetic separation. Many other examples are also possible, but time and space limitations prevent including an exhaustive list of those examples in one document. Accordingly, other examples within the scope of the claims will become apparent to those skilled in the art from the teachings of this application.

Some examples may include methods of separating semiconducting carbon nanotubes from conducting carbon nanotubes using magnetic microparticles, or magnetic nanoparticles. The substrates may then be used for a wide variety of applications such as transparent conductive coatings or as a semiconducting material for transistors.

When synthesizing carbon nanotubes, it is generally not possible to specify a particular type of tube. Instead, both metallic and semiconductive tubes (as well as varying amounts of amorphous carbon) are produced by the synthesis. As a result, a purification operation may be conducted to obtain the suitable conductive or semiconductive characteristics of an ensemble of carbon nanotubes. Various methods of purification include, for example a treatment of an ensemble of impure CNTs by organic amines. In accordance with methods disclosed herein, a treatment comprises modifying the magnetic nanoparticles with organic amines and binding the so modified magnetic nanoparticles to the CNTs. Amines bind preferentially to semiconducting tubes over metallic tubes. Using organic amines, CNTs may be separated into semiconducting and metallic fractions. Magnetic nanoparticles may thus in some instances bond to carbon nanotubes. By modifying magnetic nanoparticles or beads with the organic amines, the magnetic nanoparticles may preferentially be drawn to semiconducting tubes. A magnetic field may then be applied to attract the magnetic nanoparticles, with the semiconducting tubes associated therewith, and thus separate the semiconducting tubes from the metallic tubes.

FIG. 1 depicts a process flow of modifying a magnetic particle with organic amines, in accordance with at least some examples provided herein. Magnetic particles modified with organic amines have a higher affinity for semiconducting tubes than for metallic tubes. Thus, such modified magnetic particles preferentially bind to semiconducting tubes. Each of element numbers 10, 12, 14, and/or 16 may illustrate a stage of the process 5. Stage 10 illustrates a magnetic particle 100. Stage 12 illustrates the magnetic particle 100 with a silicon dioxide coating 110, in accordance with some examples provided herein. Stage 14 illustrates a magnetic particle 100 with a silicon dioxide coating 110 and further with an amine coating 120, in accordance with some examples provided herein. Stage 16 illustrates the magnetic particle 100 of stage 14, having a silicon dioxide coating 110 and an amine coating 120, and exhibiting an affinity for semiconducting carbon-nanotubes 130, in accordance with some examples provided herein.

The magnetic particle 100, as illustrated at stage 12, may be treated with a silicic acid to form a silica (silicon dioxide) coating 110 around the magnetic particle 100 in some examples. Silicic acid may be created by running an aqueous solution of sodium silicate through an acidic ion exchange column. The silicic acid may be made basic by titrating with tetramethylammonium hydroxide, and may be added to a basic solution of magnetic nanoparticles 100 in some examples. The resulting solution may be allowed to stir and react, then the pH may be lowered slightly and the solution allowed to react further, and then washed with water multiple times until the washings are of a neutral pH. In various examples, the resulting magnetic particles 100 thus may have a silica coating 110 formed therearound.

As shown at stage 14, the magnetic particle 100 with a silicon dioxide coating 110 may further be provided with an amine coating 120, in accordance with some examples provided herein. The magnetic particles 100 having the silica coating 110 may be treated with aminopropyltriethoxysilane (APTS). The silica-coated magnetic particles 100 may be dispersed in a solvent such as ethanol/water, and an appropriate amount of APTS is added to provide an amine coating around the magnetic particle 100 in some examples. A buffer may be used to control the pH, which may be helpful during manufacturing. The silicon dioxide coating 110 may be used to help anchor the APTS. Although the APTS may be anchored directly on the magnetic particle 100, which may require an optimization of the chemistry of the magnetic particle 100 and APTS, preferably the silica coating 110 is provided to help anchor the APTS which provides the amine coating 120 on the magnetic particle 100 in some examples.

Stage 16 thus illustrates the affinity for semiconducting carbon-nanotubes 130 exhibited by the magnetic particle 100 as modified by a silicon dioxide coating 110 and an amine coating 120. The amine coating 120 may allow the magnetic particles to attach to semiconducting carbon-nanotubes 130 in some examples, as amines have an affinity for semiconducting carbon-nanotubes.

In various examples, the magnetic particles 100 may vary in length between approximately 10 nm and approximately 10 microns. In a specific example, the magnetic particles 100 may be approximately 100 nm in length. The magnetic particles 100 may be nanoparticles or microparticles in some examples. Further, the magnetic particles 100 may be ferromagnetic or superparamagnetic in some examples.

Figure 2:
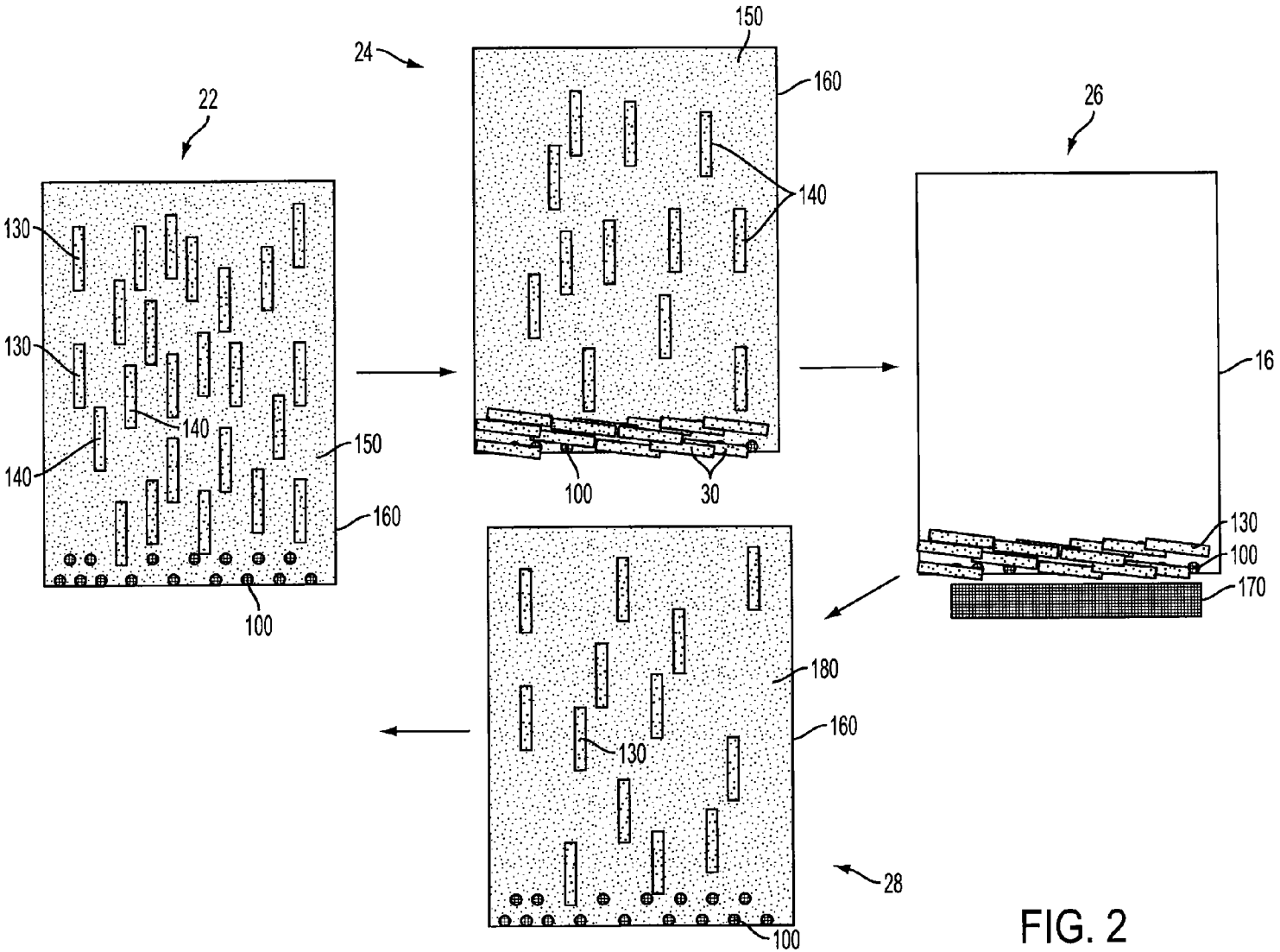
FIG. 2 depicts a process flow of a purification operation for CNTs.

FIG. 2 depicts a process flow of a purification operation for CNTs, in accordance with at least some examples provided herein. Each of element numbers 22, 24, 26, and/or 28 may illustrate a stage of the process 20.

Stage 22 illustrates a container 160 holding a fluid 150, in accordance with some examples provided herein. The fluid may have a carbon nanotube dispersion comprising semiconducting carbon-nanotubes 130 and metallic (conducting) carbon-nanotubes 140 in some examples. The semiconducting carbon-nanotubes 130 and metallic carbon-nanotubes 140 may be dispersed throughout the fluid 150. As shown, the container 160 further may hold magnetic particles 100, in accordance with some examples provided herein. Amine-coated magnetic particles 100 as described above may be provided in the container 160, or before or after the fluid is provided in the container 160. In some examples, as depicted in at stage 22, the amine-coated magnetic particles 100 may be provided at a bottom of the container 160. A separate source, such as another container, can be provided to provide the amine-coated magnetic particles 100 into the container 160.

Stage 24 illustrates the container 160 of stage 22 at a stage where the semiconducting carbon-nanotubes 130 attach to the magnetic particles 100, in accordance with some examples provided herein. The amines may have an affinity with semiconducting carbon-nanotubes so that the semiconducting carbon-nanotubes 130 may be drawn to the amine-coated magnetic particles 100 at the bottom of the container 160, and may attach to the amine-coated magnetic particles 100. Although in theory all the semiconducting carbon-nanotubes 130 may be drawn and attach to the amine-coated magnetic particles, generally a portion or a majority of the semiconducting carbon-nanotubes may attach to the amine-coated magnetic nanoparticles 100 in some examples. The amount of semiconducting carbon-nanotubes 130 that attach to the amine-coated magnetic nanoparticles 100 may depend on various factors, such as the amount of carbon nanotubes, the amount of fluid, the number of amine-coated magnetic nanoparticles, size of the container 160, etc.

Stage 26 illustrates the container 160 with a magnet 170 to hold the semiconducting carbon-nanotubes 130 and magnetic particles 100, in accordance with some examples provided herein. A magnet 170 may be placed underneath the container 160 where the amine-coated magnetic nanoparticles 100 and attached semiconducting carbon-nanotubes 130 lie, to hold the amine-coated magnetic nanoparticles 100 and attached semiconducting carbon-nanotubes in place in some examples. The magnet 170 may provide a magnetic field that may attracts and hold the amine-coated magnetic nanoparticles 100, and the attached semiconducting carbon-nanotubes in some examples. While holding the amine-coated magnetic nanoparticles 100 and attached semiconducting carbon-nanotubes in place using the magnet 170, the fluid 150 and metallic carbon-nanotubes 140 may be removed from the first container. The fluid 150 and metallic carbon-nanotubes 140 may be drained, or poured out of the container 160 and into a second container (not shown), or removed by any other means while holding the amine-coated magnetic nanoparticles 100 and attached semiconducting carbon-nanotubes in place using the magnet 170.

Stage 28 illustrates the container 160 of stage 26 subjected to an acid treatment, in accordance with some examples provided herein. Once the fluid 150 and metallic carbon-nanotubes 140 have been removed from the container 160, a fluid 180 comprising an acid may be provided. The acid treatment may destroy the affinity between the amine-coated magnetic particles 100 and the semiconducting carbon-nanotubes 130, allowing the semiconducting carbon-nanotubes 130 to detach from the amine-coated magnetic particles 100 and redisperse in the container 160 in some examples.

The semiconducting carbon-nanotubes 130 may be collected if desired from the container 160. Various methods and processes may be used to collect the semiconducting carbon-nanotubes 130 as would be appreciated by one of ordinary skill in the art, such as by filtration, for example.

Alternatively, instead of collecting the semiconducting carbon-nanotubes 130, the fluid 180 may be made basic, and the amine-coated magnetic particles 100 may again attract the semiconducting carbon-nanotubes 130, and the process may be repeated to purify the semiconducting carbon-nanotubes 130, until it is desired to collect the semiconducting carbon-nanotubes 130.

Further, the entire process 20 may be repeated for the second container (not shown). As described above, the fluid 150 and metallic carbon-nanotubes 140 may be poured or drained into a second container. Because during the process 20 not all of the semiconducting carbon-nanotubes 130 attach to the amine-coated magnetic particles 100, the fluid 150 (carbon nanotube dispersion) may still have both metallic carbon-nanotubes 140 and a portion of semiconducting carbon-nanotubes 130. Accordingly, amine-coated magnetic particles 100 may be provided for again in the second container and the process repeated.

Alternatively, if the magnet 170 is placed inside the container 160 during the process, the magnet 170 may be removed with the attached amine-coated magnetic particles 100 and attached semiconducting carbon-nanotubes 130, so the fluid 150 and metallic carbon-nanotubes 140 may remain in the first container 160. Then, the process may be repeated in the first container 160 for the separation of the metallic carbon-nanotubes 140 and the semiconducting carbon-nanotubes 130.

The container 160 may be a beaker, a large scale housing for manufacture at a plant, or any other structure for containing a fluid 150. The fluid 150 may be water or any organic solvent, solution, etc. that may provide a carbon nanotube dispersion. The magnet 170 may be placed inside the container 160, outside the container 160, or may be part of or built into the container 160. Various magnets may be used, such as but not limited to permanent magnets, composites (ceramic, ferrite, alnico, ticonal, injection molded, flexible), rare earth magnets, single-molecule magnets (SMMs), single-chain magnets (SCMs), and/or nano-structured magnets.

Figure 3:
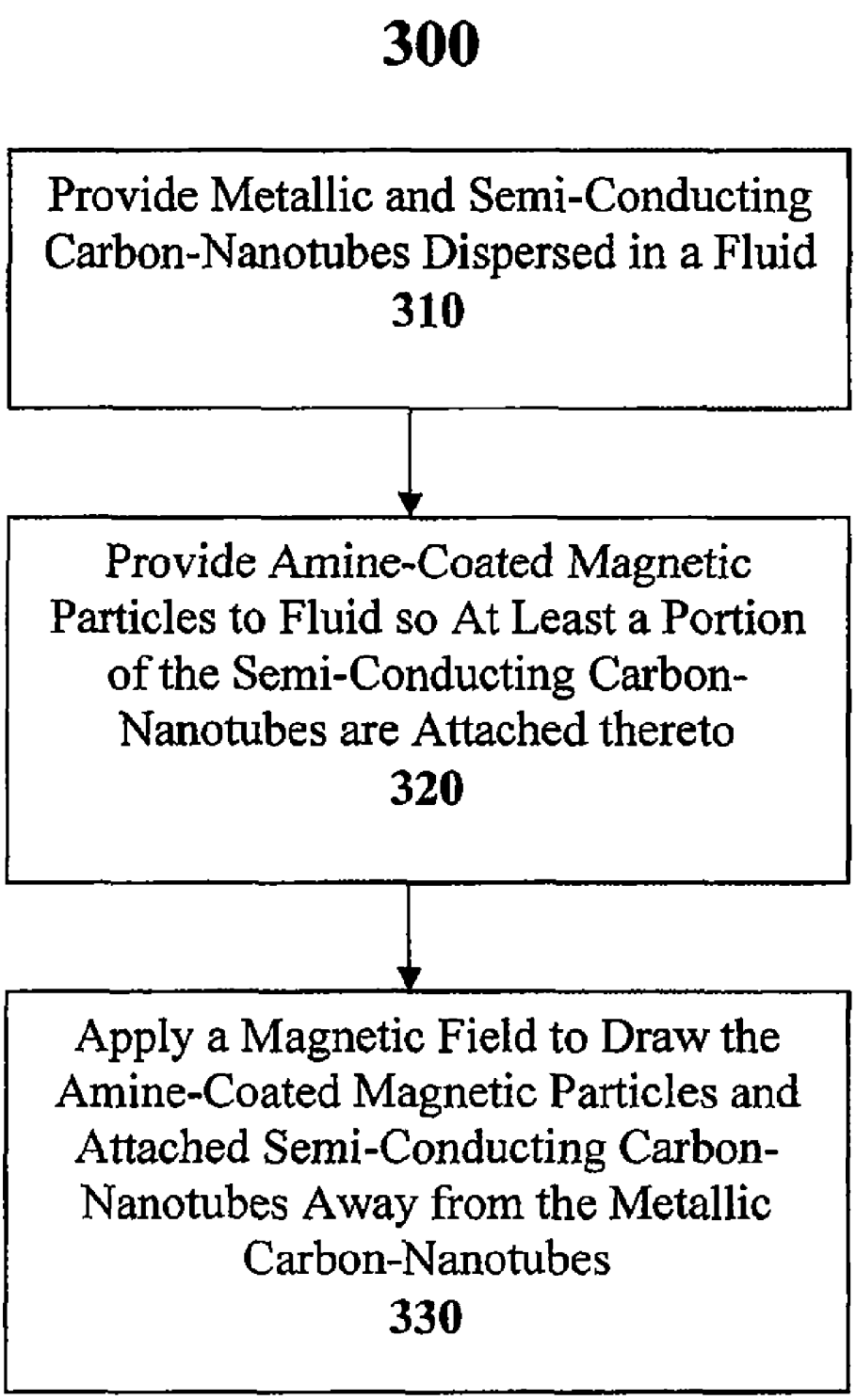
FIG. 3 depicts a flow diagram illustrating a method of separating carbon nanotubes.

FIG. 3 depicts a flow diagram illustrating a method 300 of separating carbon nanotubes, in accordance with at least some examples provided herein. Method 300 may include one or more functional or procedural operations illustrated by blocks 310, 320 and/or 330. Initially, at block 310, metallic and semiconducting carbon-nanotubes may be provided dispersed in a fluid At block 320, amine-coated magnetic particles may be provided to the fluid so that at least a portion of the semiconducting carbon-nanotubes are attached thereto. At block 330, a magnetic field may be applied to draw the amine-coated magnetic particles and attached semiconducting carbon-nanotubes away from the metallic carbon-nanotubes.

Figure 4:
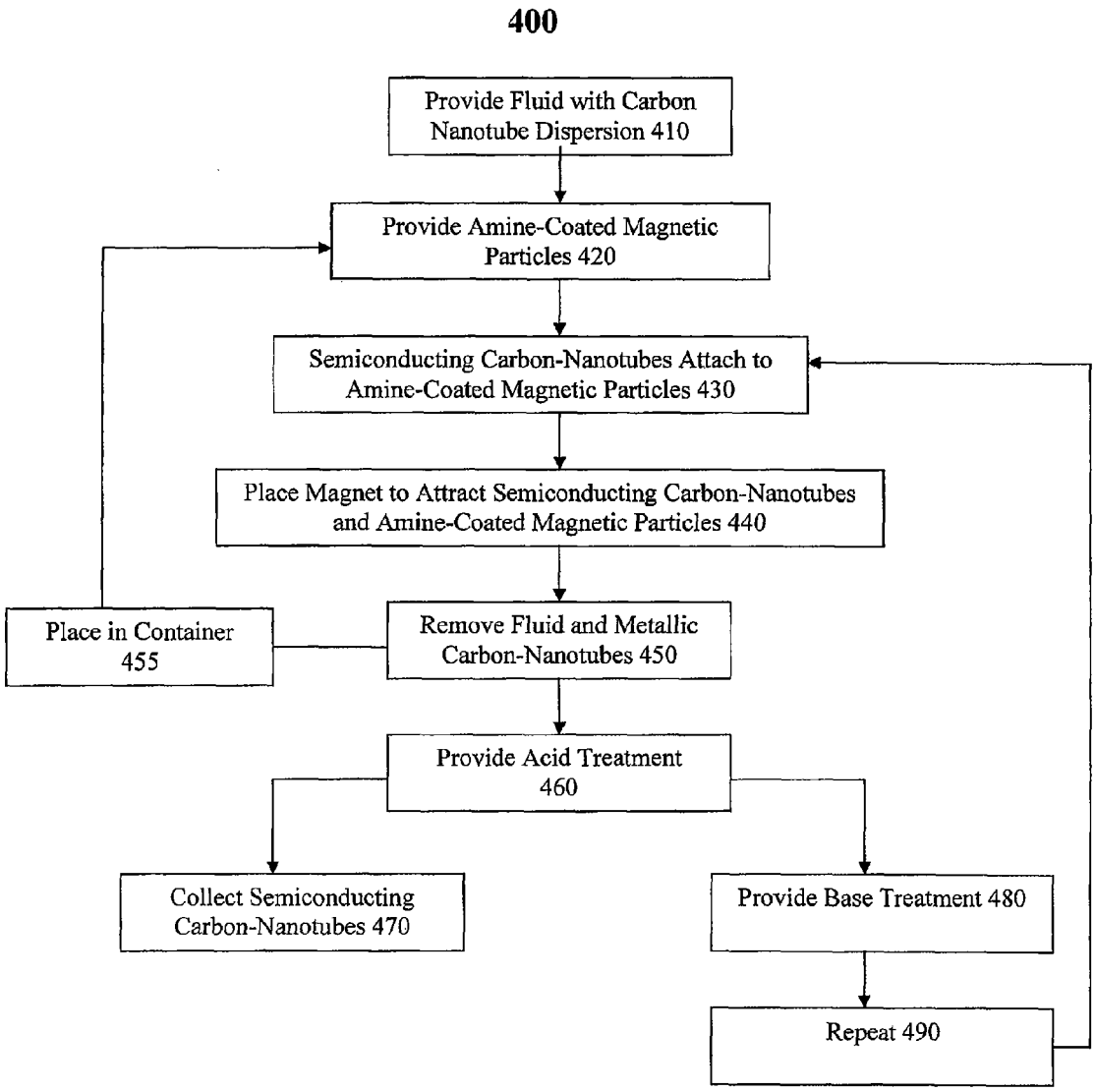
FIG. 4 depicts a flow diagram illustrating an additional example method of separating carbon nanotubes.

FIG. 4 depicts a flow diagram illustrating an additional example method 400 of separating carbon nanotubes, in accordance with at least some examples provided herein. Method 400 may include one or more functional or procedural operations illustrated by blocks 410, 420, 430, 440, 450, 455, 460, 470, 480, and/or 490. Initially, at block 410, a fluid may be provided having a carbon nanotube dispersion. In some examples, the carbon nanotube dispersion may comprise metallic carbon-nanotubes and semiconducting carbon-nanotubes. The fluid may be water or any organic solvent suitable for dispersing the carbon nanotubes. The fluid may be provided in a first container or any other type of housing structure. At block 420, amine-coated magnetic particles may be provided in the fluid. Because of the affinity of the amines with the semiconducting carbon-nanotubes, at least a portion of the semiconducting carbon-nanotubes may attach to the amine-coated magnetic particles at block 430.

At block 440, a magnet may be placed to attract semiconducting carbon-nanotubes and amine-coated magnetic particles. The magnet may be positioned at any suitable location including inside or outside of the container or built into the container. The magnet may create a magnetic field that may attract and holds the amine-coated magnetic particles (and attached semiconducting carbon-nanotubes) in place. Thus, as shown at block 450, the fluid and metallic carbon-nanotubes 450 may be removed. Generally, the fluid and metallic carbon-nanotubes may be removed from the container so that only the amine-coated magnetic particles and attached semiconducting carbon-nanotubes remain in the container. The fluid and metallic carbon-nanotubes may be placed inside another container at block 455, and the process may be repeated at block 420 so that more semiconducting carbon-nanotubes may be separated from the carbon nanotube dispersion in the fluid. The metallic carbon-nanotubes may also be collected from the fluid once the process has been repeated until all or a majority of the semiconducting carbon-nanotubes have been separated and removed from the carbon nanotube dispersion in the fluid.

Alternatively, the magnet may be removed with the attached amine-coated magnetic particles and semiconducting carbon-nanotubes from the container so that only the fluid and metallic carbon nanotubes remain in the first container, and the process may be repeated for the first container.

Once the fluid and metallic carbon-nanotubes are removed at block 450, an acid treatment may be provided at block 460. The acid treatment may be to the amine-coated magnetic particles and semiconducting carbon-nanotubes so that the affinity of the amine-coated magnetic particles and semiconducting carbon-nanotubes is broken, and the amine-coated magnetic particles detach from the semiconducting carbon-nanotubes. Then, the semiconducting carbon-nanotubes may be collected at block 470.

Alternatively, a base treatment may be provided at block 480 to re-establish the affinity of the amine-coated magnetic particles with the semiconducting carbon-nanotubes at block 480. The process may then be repeated at block 490 to block 430 to purify the semiconducting carbon-nanotubes until desired, and then the semiconducting carbon-nanotubes may be collected when desired.

Figure 5:
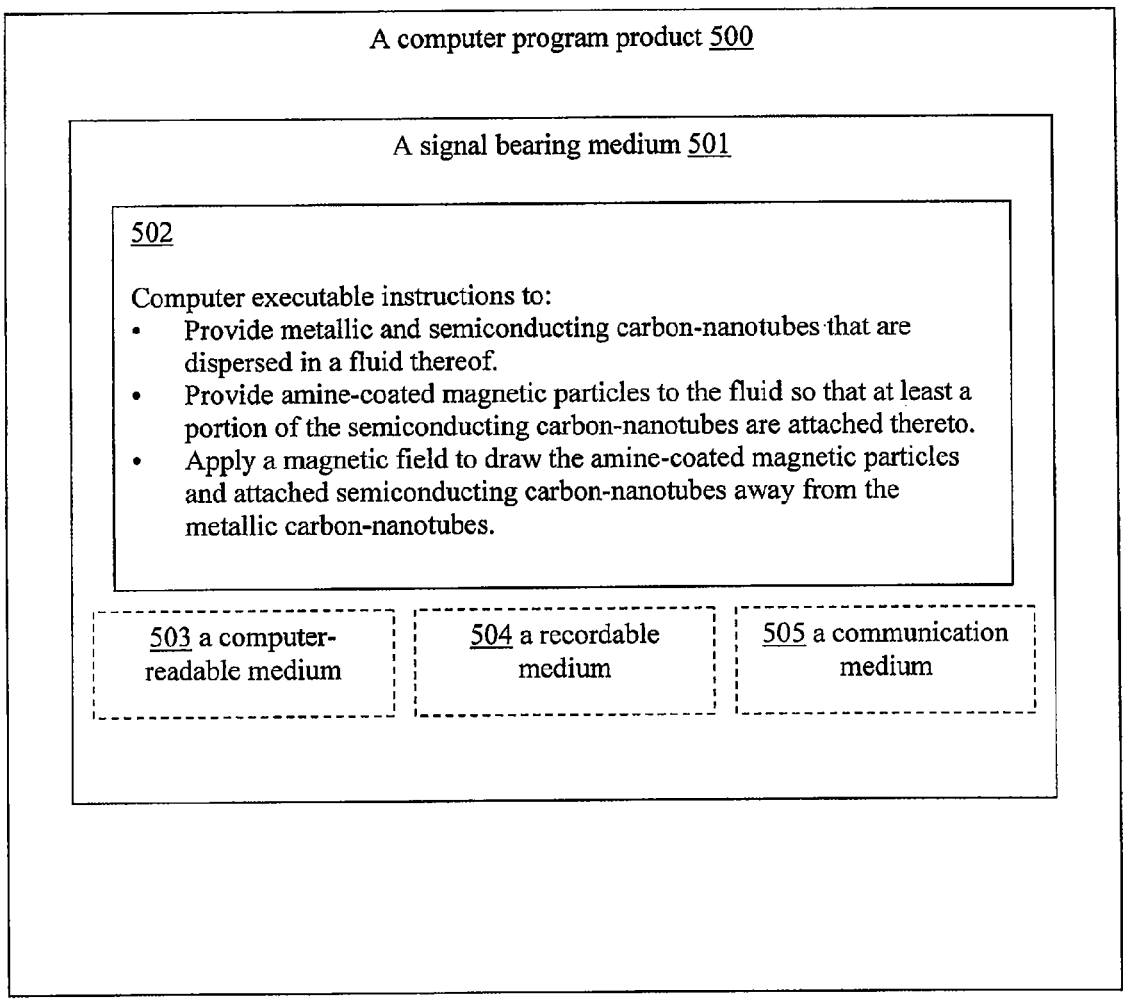
FIG. 5 illustrates a block diagram of an example computer program product; all arranged in accordance with at least some embodiments of the present disclosure.

FIG. 5 illustrates a block diagram of an example computer program product in accordance with at least some examples of the present disclosure. In some examples, a computer program product 500 includes a signal bearing medium 501 that may also include computer executable instructions 502. Computer executable instructions 502 may be arranged to provide instructions for separating carbon nanotubes. Such instructions may include, for example, instructions relating to providing metallic and semiconducting carbon-nanotubes that are dispersed in a fluid thereof. Such instructions further may include, for example, instructions relating to providing amine-coated magnetic particles to the fluid so that at least a portion of the semiconducting carbon-nanotubes are attached thereto. Such instructions further may include, for example, instructions relating to applying a magnetic field to draw the amine-coated magnetic particles and attached semiconducting carbon-nanotubes away from the metallic carbon-nanotubes. Generally, the computer executable instructions 502 may include instructions for performing any operations of the method for separating carbon nanotubes described herein.

Also depicted in FIG. 5, in some examples, computer product 500 may include one or more of a computer readable medium 503, a recordable medium 504 and a communications medium 505. The dotted boxes around these elements may depict different types of mediums that may be included within, but not limited to, signal bearing medium 501. These types of mediums may distribute programming instructions 502 to be executed by computer devices including processors, logic and/or other facility for executing such instructions. Computer readable medium 503 and recordable medium 504 may include, but are not limited to, a flexible disk, a hard disk drive (HDD), a Compact Disc (CD), a Digital Video Disk (DVD), a digital tape, a computer memory, etc. Communication medium 505 may include, but is not limited to, a digital and/or an analog communication medium (e.g., a fiber optic cable, a waveguide, a wired communication link, a wireless communication link, etc.).

The various aspects, features or implementations of examples of the present disclosure described herein may be used alone or in various combinations. The method examples of the present disclosure may be implemented by software, hardware or a combination of hardware and software (e.g., software stored on a computer-accessible medium).

The present disclosure is not to be limited in terms of the particular examples described in this application, which are intended as illustrations of various aspects. Many modifications and examples may be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is to be understood that this disclosure is not limited to particular devices, methods, systems, which may, of course, vary. It is also to be understood that the terminology used herein is for the purpose of describing particular examples only, and is not intended to be limiting.

The foregoing describes various examples of separating conducting (metallic) and semiconducting carbon nanotubes in a carbon nanotube dispersion. Following are specific examples of methods and apparatuses thereof. These are for illustration only and are not intended to be limiting. The present disclosure generally relates to apparatuses, systems and methods for separating carbon nanotubes.

Provided and described herein, for example, is a method for separating carbon nanotubes, comprising providing metallic and semiconducting carbon-nanotubes that are dispersed in a fluid thereof, providing amine-coated magnetic particles to the fluid so that at least a portion of the semiconducting carbon-nanotubes are attached thereto, and applying a magnetic field to draw the amine-coated magnetic particles and attached semiconducting carbon-nanotubes away from the metallic carbon-nanotubes.

The method can further comprise, after applying the magnetic field, separating the amine-coated magnetic particles and attached semiconducting carbon-nanotubes from the metallic carbon-nanotubes therein. The separating of the amine-coated magnetic particles and attached semiconducting carbon-nanotubes can include separating the amine-coated magnetic particles and attached semiconducting carbon-nanotubes from the fluid. The fluid can be provided in a first container, and the magnetic field be applied by a magnet outside the first container. The magnetic field can be applied using a magnet to hold the amine-coated magnetic particles and attached semiconducting carbon-nanotubes in place, while the fluid and metallic carbon-nanotubes are separated from the amine-coated magnetic particles and attached semiconducting carbon-nanotubes.

The fluid and metallic carbon-nanotubes can also be provided in a second container. The method can further comprise providing amine-coated magnetic particles to the fluid in the second container so that at least another portion of semiconducting carbon-nanotubes remaining in the fluid are attracted and attach to the amine-coated magnetic particles. The method can also further comprise applying a magnetic field to hold the at least another portion of the amine-coated magnetic particles and semiconducting carbon-nanotubes attached thereto while the fluid is removed from the second container. After the separating of the amine-coated magnetic particles and attached semiconducting carbon-nanotubes from the metallic carbon-nanotubes and fluid, the method can comprise treating the amine-coated magnetic particles and attached semiconducting carbon-nanotubes with an acid to detach the amine-coated magnetic particles from the semiconducting carbon-nanotubes.

Also provided and described herein, for example, is an apparatus for separating carbon nanotubes, the apparatus comprising a first container, a source configured to provide a fluid, metallic and semiconducting carbon-nanotubes to the first container, and amine-coated magnetic particles into the first container, and a magnet associable with the first container and adapted to attract the amine-coated magnetic particles to enable the separation of the amine-coated magnetic particles and attached semiconducting carbon-nanotubes from the metallic carbon-nanotubes.

The apparatus can further comprise a second container and draining mechanism configured to drain the fluid and metallic carbon nanotubes therein from the first container. The apparatus can further comprise a filter configured to separate the metallic carbon nanotubes from the fluid in the second container, and an acid treatment device that includes an acid source and is associated with the first container to conduct an acid treatment to separate the semiconducting carbon-nanotubes from the amine-coated magnetic particles.

Also provided and described herein, for example, is a carbon nanotube separation system, comprising a first container adapted to contain a fluid therein, the fluid having metallic and semiconducting carbon-nanotubes dispersed therein, a particle source for providing amine-coated magnetic particles into the fluid to attract and attach thereto at least a portion of the semiconducting carbon-nanotubes, and a magnet adapted to draw the amine-coated magnetic particles and attached semiconducting carbon-nanotubes away from the metallic carbon-nanotubes. The magnet can be disposed outside the first container, and the first container can be configured and dimensioned to permit the magnetic field from the magnet to attract and retain the amine-coated magnetic particles and attached semiconducting carbon-nanotubes.

The carbon nanotube separation system can further comprise a second container adapted to receive the fluid and the metallic carbon-nanotubes therein, and wherein the magnet retains the amine-coated magnetic particles and attached semiconducting carbon-nanotubes in the first container. The carbon nanotube separation can further comprise an acid treatment device configured to provide an acid treatment in the second container to detach the amine-coated magnetic particles from the attached semiconducting carbon-nanotubes. The amine-coated magnetic particles can be amine-coated magnetic nanoparticles or amine-coated magnetic microparticles. The amine-coated magnetic particles can be superparamagnetic or ferromagnetic, and the amine-coated magnetic particles can be coated with silicon dioxide.

Also provided and described herein, for example, is a computer-readable medium comprising computer readable instructions which are provided for separating carbon nanotubes wherein, when a processing arrangement executes the instructions, the processing arrangement is configured for providing metallic and semiconducting carbon-nanotubes that are dispersed in a fluid thereof, providing amine-coated magnetic particles to the fluid so that at least a portion of the semiconducting carbon-nanotubes are attached thereto, and applying a magnetic field to draw the amine-coated magnetic particles and attached semiconducting carbon-nanotubes away from the metallic carbon-nanotubes.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those,within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range may be easily recognized as sufficiently describing and enabling the same range being broken down into at least equal halves, thirds, quarters, fifths, tenths, etc. As a non-limiting example, each range discussed herein may be readily broken down into a lower third, middle third and upper third, etc. As will also be understood by one skilled in the art all language such as "up to," "at least," "greater than," "less than," and the like include the number recited and refer to ranges which may be subsequently broken down into subranges as discussed above. Finally, as will be understood by one skilled in the art, a range includes each individual member.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A method for separating carbon nanotubes, comprising:

providing metallic and semiconducting carbon-nanotubes that are dispersed in a fluid thereof;

providing amine-coated magnetic particles to the fluid so that at least a portion of the semiconducting carbon-nanotubes are attached thereto;

applying a magnetic field to draw the amine-coated magnetic particles and attached semiconducting carbon-nanotubes away from the metallic carbon-nanotubes;

separating the amine-coated magnetic particles and attached semiconducting carbon-nanotubes from the metallic carbon-nanotubes; and treating the amine-coated magnetic particles and attached semiconducting carbon-nanotubes with an acid to detach the amine-coated magnetic articles from the semiconducting carbon-nanotubes.

2. The method of claim 1, wherein the separating of the amine-coated magnetic particles and attached semiconducting carbon-nanotubes includes separating at least one of the amine-coated magnetic particles and the attached semiconducting carbon-nanotubes from the fluid.

3. The method of claim 1, wherein the fluid is provided in a first container, and the magnetic field is applied by a magnet outside the first container.

4. A method for separating carbon nanotubes comprising:

providing metallic and semiconducting carbon-nanotubes that are dispersed in a fluid thereof;

providing amine-coated magnetic particles to the fluid so that at least a portion of the semiconducting carbon-nanotubes are attached thereto;

applying a magnetic field to draw the amine-coated magnetic particles and attached semiconducting carbon-nanotubes away from the metallic carbon-nanotubes, wherein the magnetic field is applied using a magnet to hold the amine-coated magnetic particles and attached semiconducting carbon-nanotubes in place, while the fluid and metallic carbon-nanotubes are separated from the amine-coated magnetic particles and attached semiconducting carbon-nanotubes.

5. The method of claim 4, wherein the fluid and metallic carbon-nanotubes are provided in a second container.

6. The method of claim 5, further comprising providing amine-coated magnetic particles to the fluid in the second container so that at least another portion of semiconducting carbon-nanotubes remaining in the fluid are attracted and attach to the amine-coated magnetic particles.

7. The method of claim 6, further comprising applying a magnetic field to hold the at least another portion of the amine-coated magnetic particles and semiconducting carbon-nanotubes attached thereto while the fluid is removed from the second container.

8. A computer-readable medium comprising computer readable instructions which are provided for separating carbon nanotubes wherein, when a processing arrangement executes the instructions, the processing arrangement is configured for:

providing metallic and semiconducting carbon-nanotubes that are dispersed in a fluid thereof;

providing amine-coated magnetic particles to the fluid so that at least a portion of the semiconducting carbon-nanotubes are attached thereto;

applying a magnetic field to draw the amine-coated magnetic particles and attached semiconducting carbon-nanotubes away from the metallic carbon-nanotubes;

separating the amine-coated magnetic particles and attached semiconducting carbon-nanotubes from the metallic carbon-nanotubes: and treating the amine-coated magnetic particles and. attached semiconducting carbon-nanotubes with an acid to detach the amine-coated magnetic particles from the semiconducting carbon-nanotubes.

9. The method of claim 1, wherein the fluid is provided in a first container, the method further comprising draining the fluid into a second container.

10. The method of claim 1, further comprising filtering the metallic carbon nanotubes from the fluid.

11. The method of claim 4, further comprising acid treating the amine-coated magnetic particles and attached semiconducting carbon-nanotubes to detach the amine-coated magnetic particles form the semiconducting carbon nanotubes.

12. The method of claim 5, further comprising, prior to said providing amine-coated magnetic particles to the fluid in the second container, base treating the amine-coated magnetic particles.

13. The method of claim 4, further comprising controlling said applying a magnetic field according to a predetermined set of instructions using at least one of a processor or a computer readable medium.

14. The method of claim 1, wherein the amine-coated magnetic particles comprise at least one of nanoparticles or micro particles.

15. The method of claim 1, wherein the amine-coated magnetic particles are at least one of superparamagnetic or ferromagnetic.

* * * * *

UNITED STATES PATENT AND TRADEMARK OFFICE

CERTIFICATE OF CORRECTION

PATENT NO. : 8,297,444 B2
APPLICATION NO. : 12/546516
DATED : October 30, 2012
INVENTOR(S) : Miller It is certified that error appears in the above-identified patent and that said Letters Patent is hereby corrected as shown below:

On the Face Page, in Field (56), under "OTHER PUBLICATIONS", in Column 2, Line 7, delete "2003,." and insert -- 2003. --, therefor.

In Column 1, Line 6, delete "(CNTS)" and insert -- (CNTs) --, therefor.

In Column 8, Line 65, delete "those,within" and insert -- those, within --, therefor.

In Column 10, Line 21, in Claim 1, delete "articles" and insert -- particles --, therefor.

In Column 11, Line 6, in Claim 8, delete "carbon-nanotubes:" and insert -- carbon-nanotubes; --, therefor.

In Column 11, Line 7, in Claim 8, delete "and." and insert -- and --, therefor.

In Column 12, Line 2, in Claim 11, delete "form" and insert -- from --, therefor.

Signed and Sealed this
Second Day of April, 2013

Teresa Stanek Rea

Teresa Stanek Rea
*Acting Director of the United States Patent and Trademark Office*